United States Patent [19]

Bjorn et al.

[11] 4,355,761

[45] Oct. 26, 1982

[54] PRESSURE SENSOR AND REGULATOR FOR AIRLESS MATERIAL COATING SYSTEM

[75] Inventors: Thomas E. Bjorn, Northbrook; Mark C. C. Kao, Elmhurst, both of Ill.

[73] Assignee: Stewart-Warner Corporation, Chicago, Ill.

[21] Appl. No.: 131,191

[22] Filed: Mar. 17, 1980

[51] Int. Cl.[3] ..... F04B 49/08

[52] U.S. Cl. ..... 239/126; 200/81.9 R; 200/83 B; 200/83.4; 417/38

[58] Field of Search ..... 239/124, 126, 127; 417/38; 200/81 R, 82 A, 83 A, 83 V, 83 S, 83 Y, 81.9 R, 83 R, 83 B, 83 P, 83 SA

[56] References Cited

U.S. PATENT DOCUMENTS

| | | | |
|---|---|---|---|
| 2,808,484 | 10/1957 | Beck et al. | 200/83 Y |
| 3,466,978 | 9/1969 | Carlstedt | 200/83 Y X |
| 4,212,591 | 7/1980 | Lamontagne et al. | 417/38 |

*Primary Examiner*—Andres Kashnikow
*Attorney, Agent, or Firm*—Augustus G. Douvas

[57] ABSTRACT

An airless paint or material spray system having a pressure sensor and regulator for controlling the pressure of paint flowing from a paint pump to an airless spray gun. The pressure sensor and regulator includes three contiguous flexing diaphragms in a material chamber in the outlet flow line of the pump with the outermost diaphragm in direct contact with material being constructed of a thin plastic impervious to attack by common painting or coating materials. The two other diaphragms are rubber coated fabric diaphragms that axially position a precision steel rod movably mounted in a low clearance bore in a regulator housing. The axial movement of the precision rod is converted to rotational movement by an adjustably spring biased, pivotally mounted member in the housing having a universal connection with the precision rod. A normally closed snap action switch in the housing is actuated after a predetermined axial travel of the precision rod by an amplifier bar connected to the pivotally mounted member. This snap action switch is adapted to energize a dumping valve in the outlet of the pump at approximately 60 cycles per minute to maintain a desired pump outlet pressure.

17 Claims, 4 Drawing Figures

10
11
12
13
14
15
16
17
18
19
20
21
22
23
24
25
26
27
28
29
37
2.
2.

PRESSURE SENSOR AND REGULATOR FOR AIRLESS MATERIAL COATING SYSTEM

BACKGROUND OF THE PRESENT INVENTION

In airless material coating spray systems, it is important to accurately control the pressure of material flowing from a pump to the airless spray gun in order to provide a well distributed and well defined spray pattern. In airless spray systems, the paint is atomized in the spray gun without the interposition of any compressed air as used in conventional spray systems such as employed in automobile painting. In the air type material spray systems, it is more important to regulate the pressure of air to control the spray pattern rather than control of paint pressure.

In contrast to the air systems, in airless systems the paint is delivered under controlled high pressure from a reservoir, sometimes from a mobile reciprocating piston pump unit that rests on the floor mounted directly over the reservoir. An on-off regulator is provided for the pump motor both for initiating and terminating paint flow to the spray gun, and also for controlling the paint outlet pressure. It is desirable that paint outlet pressure remains substantially constant from the pump to control paint delivery rate as well as the spray pattern, and to do this it is necessary to energize and deenergize the pump motor fairly rapidly.

In the past the cycling of the pump motor has been controlled by pressure sensors of the piston type, but these have been found undesirable since the O-rings surrounding these pistons wear as a result of the abrasive effect of the paint and require frequent and expensive maintenance.

It is a primary object of the present invention to ameliorate the problems noted above in pressure sensors and regulators for airless paint spray systems.

SUMMARY OF THE PRESENT INVENTION

In accordance with the present invention, an airless material coating spray system is provided wherein material pressure is accurately controlled by a diaphragm type pressure sensor and a pivotal bar switch actuating mechanism. Toward this end a diaphragm assembly is mounted in a chamber communicating directly with the outlet flow of material from the paint pump. The diaphragm assembly consists of three diaphragms including a plastic diaphragm, preferably constructed of "Mylar," being the only diaphragm in direct contact with paint or other coating material in the chamber so that the diaphragm assembly is impervious to the abrasive attack of material flowing through the chamber. The two other diaphragms are mounted adjacent to this plastic outer diaphragm and are of a rubber coated fabric material, substantially thicker than the plastic diaphragm, that provide the necessary flexing action of the diaphragm assembly. These diaphragms are mounted over a precision machined bore in the sensor housing that receives a precision machined rod in a very low clearance bore to maintain friction between the rod and the housing bore at a minimum, increasing the accuracy of the sensor. This rod directly engages the inner one of the rubber coated fabric diaphragms to be shifted thereby axially inwardly as the pressure in the material chamber rises.

The axial movement of the precision sensing rod is limited to several thousandths of an inch every cycle with approximately a fifteen thousandths inch maximum axial movement so that the diaphragm assembly has only limited flexing movement during each cycle to significantly extend the life of the diaphragms to more than one million cycles at three thousand p.s.i. at 60 cycles per minute. This is achieved by the provision of a stop press-fitted on the sensing rod and engaged and biased by a centering washer mounted in the housing. As the precision rod moves inwardly under the force of material pressure, the stop compresses the washer to a flat condition, thereby preventing further movement of the rod in a simple but accurate manner.

The axial movement of the precision rod is translated into transverse axial movement of a plunger in a snap action switch by a pivotally mounted amplifier assembly. The amplifier assembly converts the axial movement of the precision rod to rotational movement and the rotational movement into axial movement of the snap action switch plunger and this reduces the axial length of the entire sensor and at the same time eliminates part alignment problems normally associated with diaphragm type sensor and switch assemblies having all of the parts in axial alignment.

Toward this end a pivot block member is mounted in the housing and has an off-center universal rod connection with the precision sensor bar. This pivot block member is biased against the force of pressure in the material chamber by an adjustable compression spring also universally mounted off-center to the pivot block member. By varying the spring preload bias on the pivot block member, the regulated pressure may be selected as desired. The pivot block member carries an amplifier bar that directly engages the plunger of the normally closed snap action switch and the length and offset of this bar determines the motion amplification between the precision sensing rod and the plunger of the snap action switch.

The normally closed snap action switch is connected to energize and deenergize a solenoid operated dumping valve in the outlet of the material pump to maintain the desired pressure of the material at the level selected by the spring preload on the pivotally mounted amplifier block member. An on-off switch is also provided in the sensor and regulator housing to initially activate the pump and the solenoid operated dumping valve.

DETAILED DESCRIPTION OF THE PREFERRED EMBODIMENT

Figure 1:
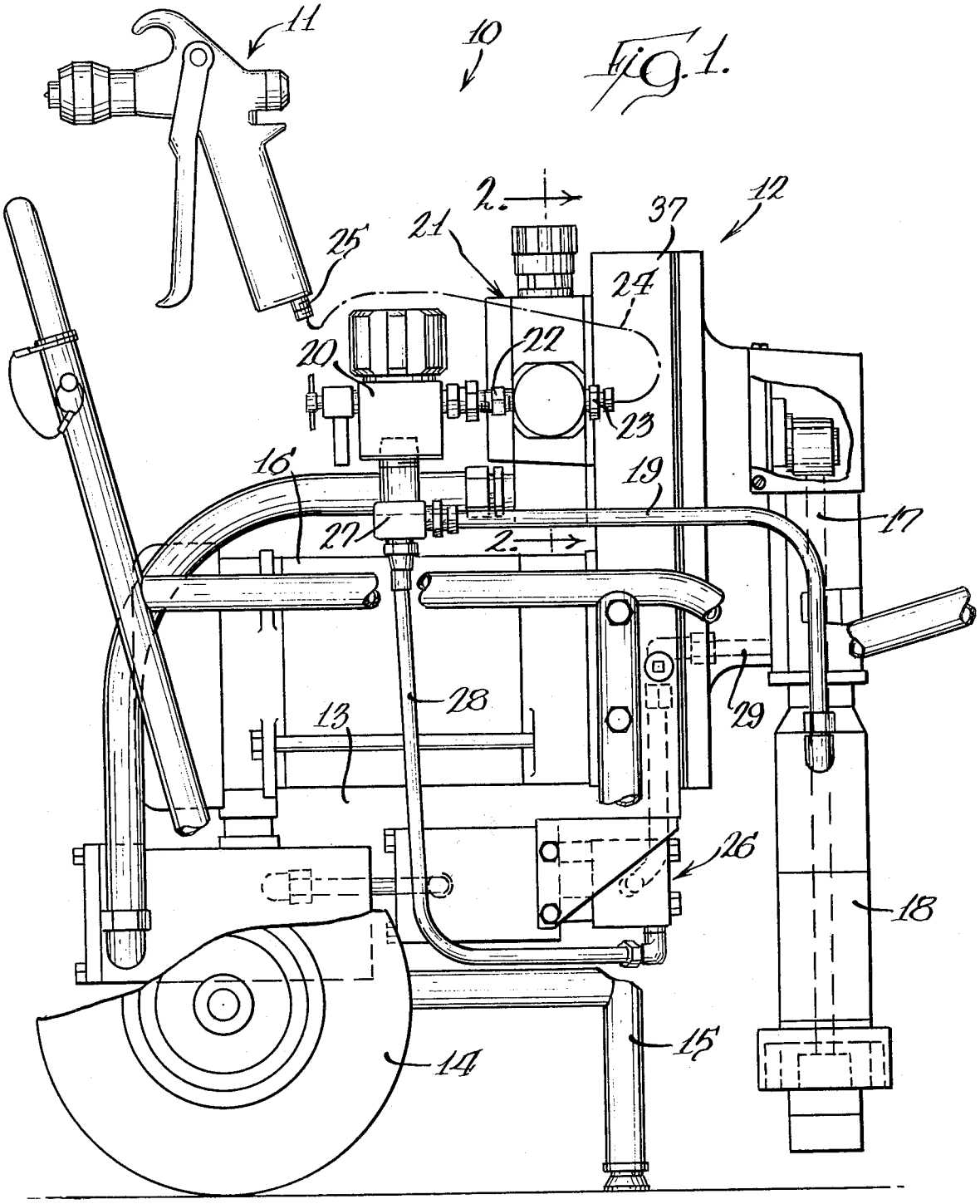
FIG. 1 is a plan view of the present airless paint spray system.

Referring to the drawings, and particularly FIG. 1, an airless paint spray system 10 is illustrated including a conventional airless spray gun 11 supplied with paint under pressure from a mobile paint pump 12. The paint pump 12 includes a frame 13 supported on the floor by spaced wheel and tire assemblies 14 and a rest stand 15. An electric motor 16 is carried by frame 13 and drives a reciprocating piston pumping element 17 through a gear reduction assembly 37. Pumping element 17 reciprocates in a cylinder 18 that projects within a paint reservoir (not shown). Paint under pressure exits the cylinder 18 through line 19, through a bleed and check valve 20, and exits valve 20 into a pressure sensor and regulator assembly 21 through an inlet fitting 22. Paint flows from the sensor and regulator assembly 21 through outlet fitting 23 and line 24 (shown schematically in FIG. 1) to an inlet fitting 25 associated with spray gun 11.

It should be understood that while the sensor and regulator assembly 21 is illustrated in a paint spray system herein, that it may also be used as well in other material spraying systems such as rust prevention coating systems.

A solenoid operated dump valve assembly 26 is provided for bypassing paint flow in line 19 back to the paint reservoir through "T" fitting 27, line 28, across dump valve 26 and through line 29 returning to the paint reservoir. This bypass function controls the paint flow to the spray gun 11. Dump valve 26 is selectively energized and deenergized by the pressure sensor and regulator assembly 21.

The apparatus described above, with the exception of the pressure sensor and regulator 21, is conventional and the following description will be substantially confined to a description of the construction and operation of the pressure sensor and regulator 21 and its control of the dump valve 26 to cycle the dump valve approximately 60 cycles per second to maintain the selected delivery pressure of material to the airless spray gun 11.

Figure 2:
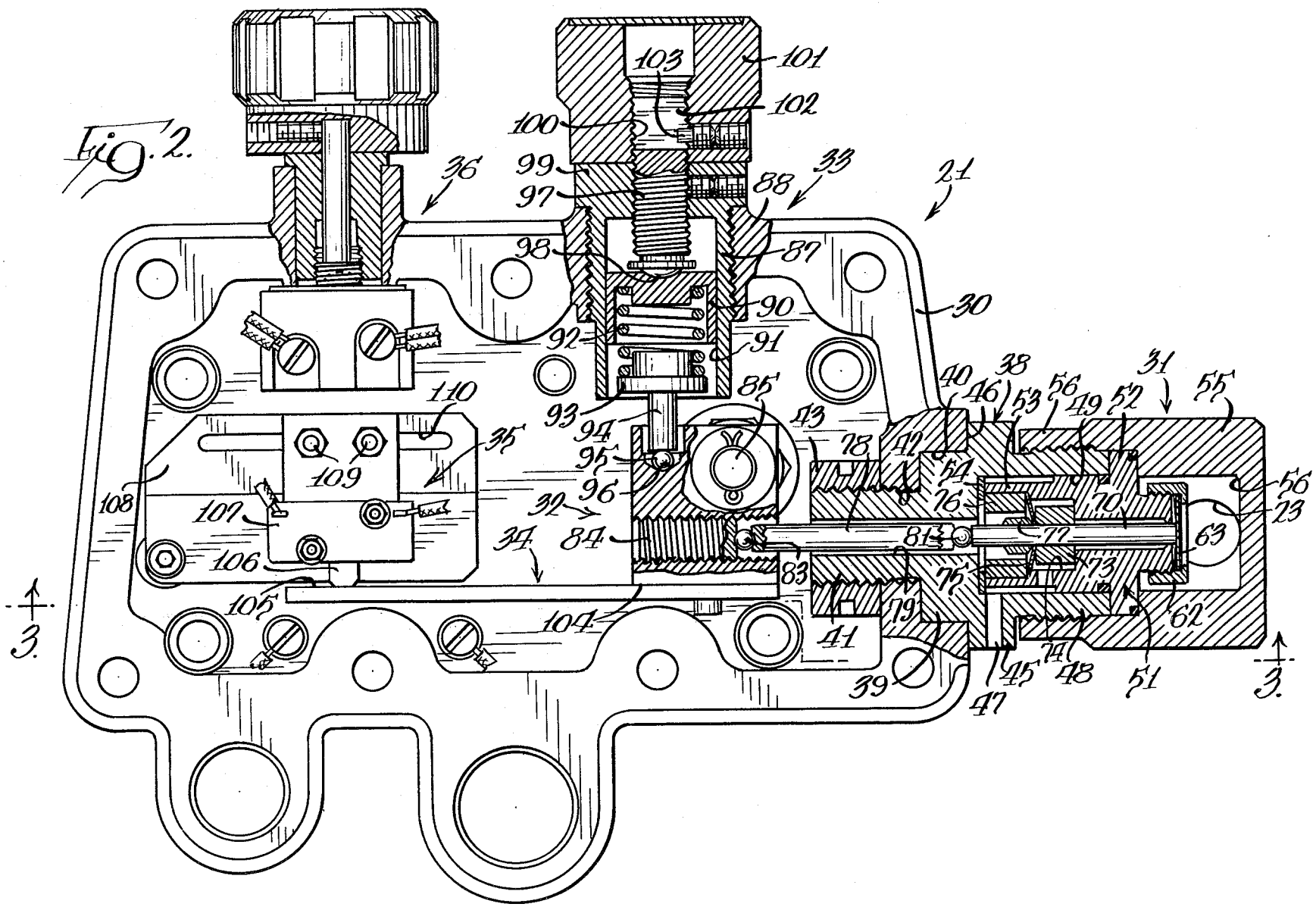
FIG. 2 is an enlarged side view, partly in section, of the pressure sensor and regulator shown in connection with the airless paint spray system illustrated in FIG. 1.
Figure 3:
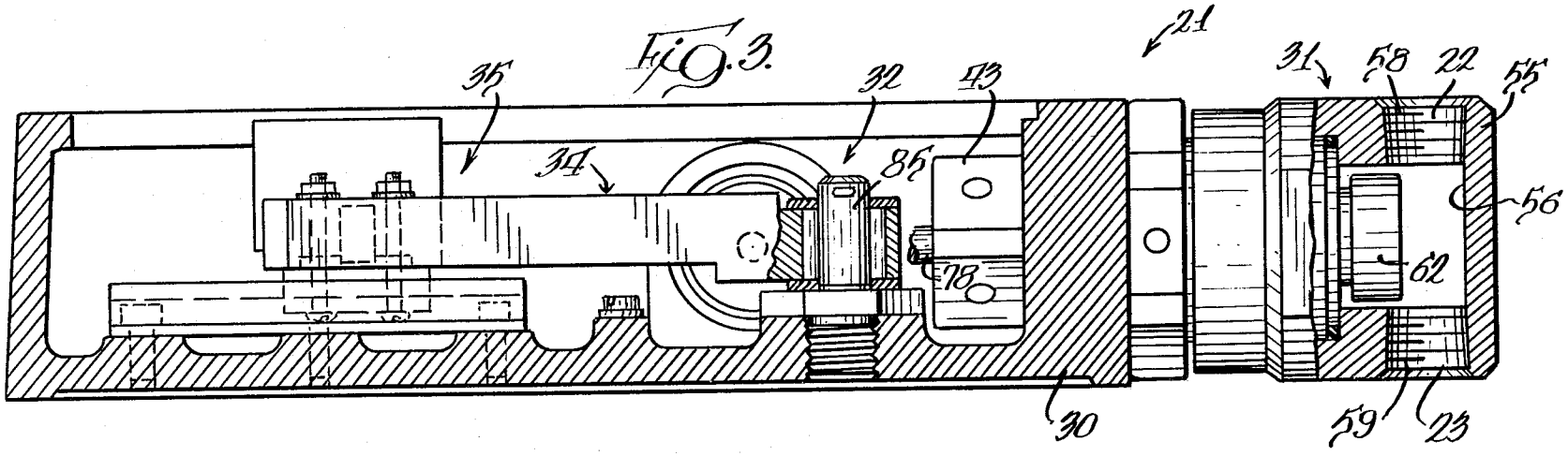
FIG. 3 is a cross-section taken generally along line 3—3 of FIG. 2.

As seen in FIGS. 2 and 3, the pressure sensor and regulator assembly 21 generally includes a housing 30, a pressure sensing diaphragm and chamber assembly 31, a pivotal diaphragm biasing block 32, an adjustable biasing assembly 33, an amplifier bar 34 connected to the pivotal block 32, and a snap action switch assembly 35 actuated by bar 34 that controls the solenoid operated dump valve 26. An on-off switch assembly 36 is provided for energizing motor 16 and the initial energization of dump valve 26.

The diaphragm and chamber assembly 31 is seen to include a stepped adaptor 38 having a boss 39 seated in a counterbore 40 in housing 30 with a threaded projection 41 extending through an opening 42 in the right end of housing 30 that has a retaining nut 43 threadedly attached thereto for rigidly securing adaptor 38 to the housing 30. Adaptor 38 has an enlarged flange 45 seated against outer surface 46 on the housing that has an opening 47 for receiving a torquing tool for securing the adaptor in position. Adaptor 38 has an outwardly extending threaded projection 48 having an enlarged central bore 49 that receives a stepped annular actuator body member 51. The body member 51 has an enlarged flange 52 seated against the end of projecting portion 48 on adaptor 38 and a reduced leftwardly extending annular portion 53 that is seated against a sealing washer 54 seated in the end of counterbore 49 in the adaptor.

The body flange 52 and the threaded projection 48 on adaptor 38 receive a cup-shaped chamber cover 55 that has a threaded portion 56 threadedly received on adaptor projection 48, a clamping flange 52 and the body member 51 in position in the adaptor bore 49.

Cup-shaped cover 55 defines a pressure sensing chamber 56 as best seen in FIGS. 2 and 3, that receives material from the pump through inlet fitting 22 (see FIG. 1) which is threadedly received in an inlet port 58. Outlet fitting 23 (see FIG. 1) is threadedly received in an outlet port 59 to convey material from chamber 56 to airless spray gun 11.

Figure 4:
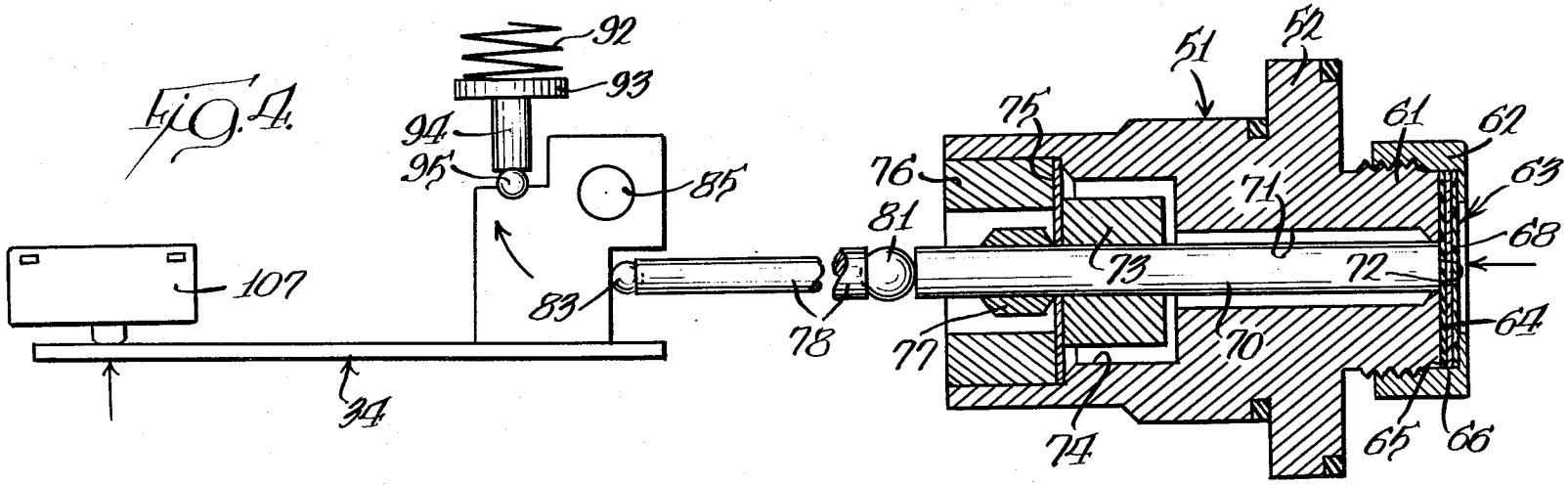
FIG. 4 is a schematic view of the pressure sensor shown in FIG. 2 with the diaphragm assembly enlarged and with the parts in their switch actuating positions.

As seen in an enlarged view in FIG. 4, the body member 51 has a reduced forwardly projecting threaded portion 61 that threadedly receives a cup-like cap 62 to clamp a diaphragm composite 63 securely against forward surface 64 of projecting portion 61. The diaphragm composite 63 includes two active rubber-coated fabric diaphragms 65 and 66 and a thin "Mylar" diaphragm 68. The Mylar diaphragm 68 (while shown thicker in FIG. 4 for clarity) is substantially thinner than the rubber-coated fabric diaphragms 65 and 66, with the "Mylar" diaphragm being approximately 0.002 inches while the diaphragms 65 and 66 are preferably on the order of 0.025 inches. Because of the outer position of the "Mylar" diaphragm 68, material does not impinge upon either of the rubber-coated fabric diaphragms 65 and 66 which prevents material from attacking these active diaphragm elements.

A hardened steel precision machined sensing rod 70 is movably mounted without contact in a low clearance central bore 71 in body member 51 for linear reciprocating movement with a negligible coefficient of friction. The end of rod 70 engages diaphragm 65 and thus the area of the end of the rod is the effective active pressure sensing area.

The rod 70 has an annular stop 73 press-fitted thereon and accurately axially fixed in position to rod 70 so that rod end 72 projects approximately 0.006 inches from the surface 64 with the right end of stop 73 engaging the right end of counterbore 74. Stop member 73 engages the forward end of counterbore 74 in body 51 to limit the forward motion of sensing rod 70. A centering washer 75 slidably engages rod 70 and is mounted within counterbore 74 and reacts against a fixed bushing 76 in an enlargement of counterbore 74 at one end and reacts at its other end against stop 73, serving primarily to center rod 70. An annular nut 77 is press-fitted on sensing rod 70 and engages washer 75 to maintain the washer in position.

As seen in FIG. 4, stop 73 and washer 75 and bushing 76 together limit the inward or leftward movement of sensing rod 70 when washer 75 moves to its flattened position shown. Stop 73 is sized and positioned so that rod end 72 is limited to approximately 0.013 inches toward travel from the surface 64 with stop 73 in the FIG. 4 inward limit position. The stop 73 is thus positioned to limit diaphragm movement to approximately 0.003 inches every cycle with a maximum movement of 0.015 inches to provide an extended life for the diaphragm composite 63 even at pressures in excess of 3000 p.s.i.

The pivotal block 32 resiliently biases the sensing rod 70 against the diaphragm composite 63 through a universal rod 78 loosely mounted in bore 79 in adaptor 38 having a recess receiving a spherical ball 81 at one end in turn received in a semi-spherical recess in the end of precision rod 70. The other end of universal rod 78 carries a similar spherical ball 83 received in a recess therein and also received in a semi-spherical recess in a threaded adjusting plug 84 threadedly received in pivot block 32. The axial set position of precision rod 70 may be adjusted by adjusting plug 84 axially in pivot block 32. Ball 83 is positioned so that the axis of rod 78 is substantially perpendicular to a line between the center of ball 83 and the pivotal axis of block 32. Universal rod 78 accommodates the linear movement of rod 70 at one end and the pivotal movement of block 32 at the other end, although movement of the left end of rod 78 is substantially linear because of its very limited axial movement and also because of the tangential position of rod 78 with respect to the axis of block 32.

The pivot block 32 is pivotally mounted on a pivot pin 85 fixed within the housing 30 and the block is biased in a counterclockwise direction by spring biasing assembly 33. The offset of the spring biasing assembly 33 from the axis of pivot pin 85 is substantially the same as the axis of rod 78, providing a one to one motion transfer to pin 70. The spring biasing assembly 33 is adjustable and includes a bushing 87 threadedly received in upper portion 88 of housing 30, having a cup-shaped spring seat plunger 90 slidably received in a counterbore 91 therein. Spring seat 90 receives a coil compression spring 92 seated on a flange 93 on biasing pin 94 that universally engages pivot block 32 through a spherical ball 95 seated in a complementary recess 96 in pivot block 32. The axis of pin 94 is substantially tangential with respect to the axis of pin 85 to assure substantially linear movement of the pin.

The position of the spring retainer plunger 90 is axially adjusted by a threaded rod 97 that has a semi-spherical stem portion 98 engaging the upper surface of plunger 90. Rod 97 is threadedly received in an upper boss portion 99 of bushing 87 and also in a central bore 100 of pressure setting knob 101. The threaded stem 97 has a diametral slot 102 therein that receives a pin 103 threadedly received in a radial hole in the knob 100 to prevent relative rotation between knob 101 and the threaded stem 97.

Knob 101 may not rotate the threaded stem 97 downwardly from the position shown in FIG. 2 which is the factory-set position, to prevent the operator from further increasing the pressure setting. By upwardly threading knob 101, however, the operator may decrease the pressure setting as desired by varying the biasing force on the pivot block 32 which in turn transmits this biasing force to the actuating rod 70 and diaphragm composite 63.

Amplifier bar 34 multiplies the very limited travel of sensing rod 70 and pivot block 32 to accommodate conventional snap action switch travel. The amplifier bar 34 is fixed at one end to lower surface 104 of the pivot block and has an upper surface 105 at the left end thereof that engages a vertically reciprocable plunger 106 in a conventional snap action switch 107 in snap action switch assembly 35. Snap action switch 107 is a normally closed switch and is fixed to a bracket 108 carried by the housing and has spaced threaded fasteners 109 received in an elongated slot 110 in the bracket 108 that permit the switch 107 to be adjusted laterally in the housing to vary the effective travel of switch plunger 107.

With the above construction, the axial movement of the diaphragm composite 63 necessary to effect switch actuation is largely controlled by (a) the length of the amplifier bar 34, (b) the lateral position of switch 107 on bracket 108, and (c) the fixed travel of plunger 106 necessary to cause switch actuation. The pressure required in chamber 56 to effect travel of the diaphragm composite 63 the required distance for switch actuation is primarily controlled by the adjustable pressure spring biasing assembly 33.

As pressure builds up in chamber 56 in response to increasing paint outlet pressure from the pump cylinder 18 through outlet line 19, the diaphragm composite 63 acting on the end of rod 70 will move the rod inwardly, rotating pivot block 32 in a clockwise direction, as seen in FIG. 2, pivoting amplifier bar 34 upwardly, and moving plunger 106 of switch 107 upwardly until switch actuation is achieved when the pressure reaches the value set on biasing assembly 33.

The diaphragm composite 63, the precision sensing rod 70, the pivot block 32, amplifier bar 34 and snap action switch 107 are shown in their maximum limit positions in FIG. 4, with the stop 73 limiting further movement of the rod 70 inwardly. The position of the parts shown in FIG. 4 is the maximum limit position and would not normally be reached during each cycle of switch 107, but merely limits the maximum movement of diaphragms 65 and 66 into body bore 71 to approximately 0.010 to 0.016 inches. In this manner the diaphragm composite 63 can flex and achieve the several thousandths of inches required for switch actuation without extruding into bore 71 to any significant extent, increasing the cycle life of the diaphragms.

The switch 107 is a normally closed snap action switch that maintains the solenoid associated with dump valve 26 energized which closes the dump valve preventing bypass flow in line 28 back to the reservoir. As pressure increases in chamber 56 above the predetermined set value, amplifier bar 34 will move upwardly an amount sufficient to cause switch actuation, opening normally closed switch 107, deenergizing the solenoid associated with dump valve 26, opening the dump valve and permitting flow from the pump through line 19 to bypass back to the reservoir through line 28, across dump valve 26 through line 29. Due to the high sensitivity of this pressure sensor and regulator 21, it will cycle the dump valve 26 on and off as many as 60 cycles per minute to achieve very accurate control over paint pressure to the airless spray gun 11.

What is claimed is:

1. In an airless material spraying system, comprising; a material spray dispenser, a source of material, pump means for conveying material under pressure from a reservoir to the material spray dispenser, valve means for controlling flow from the pump means, a pressure responsive control for the valve means including housing means, said housing means having a chamber formed therein, means communicating the material outlet flow from the pump means to the chamber, flexible diaphragm means in the chamber movable in response to increasing material pressure in the chamber, a precision bore in the housing means, a sensor rod reciprocable in said housing means precision bore and engaging said diaphragm means, spring means urging said rod against said diaphragm means, stop means on the sensor rod for limiting movement of said rod away from the chamber to reduce the amount of flexing of the diaphragm means, and switch means responsive to a predetermined movement of said rod for actuating said means for controlling flow from the pump means.

2. In an airless material spraying system as defined in claim 1, wherein said stop means is a stop member fixed on said rod.

3. In an airless material spraying system as defined in claim 2, wherein a spring washer surrounds the rod and engages the stop member.

4. In an airless material spraying system as defined in claim 1, wherein the diaphragm means includes a first plastic diaphragm directly communicating with fluid pressure in the chamber, and a second rubber diaphragm adjacent said first plastic diaphragm and engaging said rod.

5. In an airless material spraying system as defined in claim 1, wherein said rod is limited to axial sliding movement in a small clearance bore in said housing means, a pivotally mounted member in said housing means for variably biasing said rod, adjustable spring means biasing the pivotally mounted member against the force of fluid pressure in the chamber, said switch means including a switch in said housing means actuatable by said pivotally mounted member upon predetermined angular movement thereof.

6. In an airless material spraying system, comprising; a material spray dispenser, a source of material, pump means for conveying material under pressure from a reservoir to the material spray dispenser, valve means for controlling flow from the pump means, a pressure responsive control for the valve means including housing means, said housing means having a chamber formed therein, means communicating the material outlet flow from the pump means to the chamber, flexible diaphragm means in the chamber movable in response to increasing material pressure in the chamber, a sensor rod reciprocable in said housing means and engaging said diaphragm means, spring means urging said rod against said diaphragm means, stop means limiting movement of said rod away from the chamber to reduce the amount of flexing of the diaphragm means, switch means responsive to a predetermined movement of said rod for actuating said means for controlling flow from the pump means, said rod being limited to axial sliding movement in a small clearance bore in said housing means, a pivotally mounted member in said housing means for variably biasing said rod, adjustable spring means biasing the pivotally mounted member against the force of fluid pressure in the chamber, said switch means including a switch in said housing means actuatable by said pivotally mounted member upon predetermined angular movement thereof, and an amplifier bar fixed to the pivotally mounted member and engageable with said switch.

7. In an airless material spraying system, comprising; a material spray dispenser, a source of material, pump means for conveying material under pressure from a reservoir to the material spray dispenser, valve means for controlling flow from the pump means, a pressure responsive control for the valve means including housing means, said housing means having a chamber formed therein, means communicating the material outlet flow from the pump means to the chamber, flexible diaphragm means in the chamber movable in response to increasing material pressure in the chamber, a sensor rod reciprocable in said housing means and engaging said diaphragm means, spring means urging said rod against said diaphragm means, stop means limiting movement of said rod away from the chamber to reduce the amount of flexing of the diaphragm means, switch means responsive to a predetermined movement of said rod for actuating said means for controlling flow from the pump means, said rod being limited to axial sliding movement in a small clearance bore in said housing means, a pivotally mounted member in said housing means for variably biasing said rod, adjustable spring means biasing the pivotally mounted member against the force of fluid pressure in the chamber, said switch means including a switch in said housing means actuable by said pivotally mounted member upon predetermined angular movement thereof, the switch being a normally closed switch mounted for lateral movement in the housing means, and a universal rod interconnecting the pivotally mounted member and the diaphragm engaging rod.

8. In an airless material spraying system, the combination comprising; a material spray dispenser, a source of material, pump means for conveying material under pressure from the source to the material spraying dispenser, means for controlling flow from the pump means, a pressure responsive control for the means for controlling flow including housing means, said housing means having a chamber formed therein, means communicating the material outlet flow from the pump means to the chamber, a flexible diaphragm means in the chamber movable in response to increasing material pressure in the chamber, a pivotally mounted amplifier member in the housing means having means for biasing the diaphragm means in opposition to fluid pressure in said chamber, switch means actuated by the amplifier member for controlling the means for controlling flow, and adjustable spring means biasing the pivotally mounted member to vary the pressure setting for actuation of the switch means.

9. In an airless material spraying system as defined in claim 8, including a universally movable rod connecting the pivotally mounted member to the diaphragm means, and an amplifier bar connected to the pivotally mounted member engageable with the switch means for actuation thereof.

10. In an airless material spraying system as defined in claim 8, wherein the switch means is a normally closed snap action switch mounted for lateral adjustment in the housing means to vary switch sensitivity.

11. In an airless material spraying system as defined in claim 8, including an on-off switch in the housing means for controlling the initial energization of the means for controlling.

12. In an airless material spraying system, the combination comprising; a material spray dispenser, a source of material, pump means for conveying material under pressure from the source to the material spraying dispenser, a valve for controlling flow of material from the pump means, a pressure responsive control for the valve including housing means, said housing means having a chamber formed therein, means communicating the material outlet flow from the pump means to the chamber, flexible diaphragm means in the chamber movable in response to increasing material pressure in the chamber including a thin diaphragm constructed of a spray material impervious plastic communicating directly with material in the chamber, a diaphragm constructed of rubber and substantially thicker than the thin plastic diaphragm and mounted adjacent thereto, a rod reciprocable in a small clearance bore in said housing means and engaging said rubber diaphragm, a stop surrounding and connected to the rod to limit the inward movement of the rod in said housing means and thereby the inward flexing movement of the rubber diaphragm, and a washer in said housing means engaging and centering the rod.

13. In an airless material spraying system as defined in claim 12, including a pivotally mounted member mounted in said housing means and biasing said diaphragm rod, a universal rod interconnecting the pivotally mounted member and the diaphragm rod, said housing means limiting said diaphragm rod to linear movement, adjustable spring means biasing said pivotally mounted member in a direction to urge the diaphragm rod toward the diaphragms, said switch means including a switch mounted in said housing means, and an amplifier bar connected to the pivotally mounted member and engageable with the switch for actuation thereof.

14. In an airless material spraying system, the combination comprising; a material spray dispenser, a source of material, pump means for conveying material under pressure from the source to the material spraying dispenser, a valve for controlling flow from the pump means, a pressure responsive control for the valve including housing means, said housing means having a chamber formed therein, means communicating the material outlet flow from the pump means to the chamber, a flexible diaphragm means in the chamber movable in response to increasing material pressure in the chamber, a pivotally mounted member biasing said diaphragm means, a universal rod interconnecting the pivotally mounted member and the diaphragm means, an adjustable biasing spring biasing the pivotally mounted member in a direction against the force of fluid pressure in the chamber acting on the pivotally mounted member, an amplifier bar connected to the pivotally mounted member offset from the axis thereof and extending generally parallel to the universal rod, and a switch having a plunger reciprocable therein mounted adjacent the free end of the amplifier bar and actuated thereby.

15. In an airless material spraying system as defined in claim 14, wherein said diaphragm means includes a material impervious plastic diaphragm communicating directly with the material in said chamber, a rubber diaphragm substantially thicker than the plastic diaphragm and mounted adjacent thereto, a sensor rod reciprocably mounted in a small clearance bore in said housing means and engageable with said rubber diaphragm, a stop surrounding and fixed to the sensor rod to limit the inward movement of the rod in the housing means and thereby the inward flexing movement of the rubber diaphragm, and a washer in said housing means engaging and centering the sensor rod.

16. In an airless material spraying system of the type having a material spray dispenser, a source of material, pump means for conveying material under pressure from the source to the material spraying dispenser, means for controlling flow from the pump means, a pressure responsive control for the means for controlling flow including housing means, said housing means having a chamber formed therein, means communicating the material outlet flow from the pump means to the chamber, a flexible diaphragm means in the chamber movable in response to increasing material pressure in the chamber, characterized by an actuating rod coaxially positioned with respect to and positioned by the diaphragm means, a pivotally mounted member extending generally coaxially with the actuating rod and positioned thereby, switch means actuated by the pivotally mounted member for controlling the means for controlling flow, said switch means having an actuating plunger engaging the pivotally mounted member and movable on an axis transverse to the pivotally mounted member and the actuating rod, and spring means biasing the diaphragm means to controlling the pressure setting for actuation of the switch means.

17. In an airless material spraying system of the type having a material spray dispenser, a source of material, pump means for conveying material under pressure from the source to the material spraying dispenser, means for controlling flow from the pump means, a pressure responsive control for the means for controlling flow including housing means, said housing means having a chamber formed therein, means communicating the material outlet flow from the pump means to the chamber, a flexible diaphragm means in the chamber movable in response to increasing material pressure in the chamber, characterized by an actuating rod mounted for linear reciprocating movement mounted coaxially with and positioned by the diaphragm means, elongated bar means extending generally parallel to the actuating rod and pivotally mounted about an axis adjacent the axis of the actuating rod, said bar means being pivoted by the actuating rod, and switch means actuated by the bar means for controlling the means for controlling flow.

* * * * *